US006685050B2

(12) United States Patent
Schmidt et al.

(10) Patent No.: US 6,685,050 B2
(45) Date of Patent: Feb. 3, 2004

(54) FOLDED SHEET PRODUCT, DISPENSER AND RELATED ASSEMBLY

(75) Inventors: Paul R. Schmidt, Neenah, WI (US); Leslie T. Long, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 44 days.

(21) Appl. No.: 10/027,255

(22) Filed: Dec. 20, 2001

(65) Prior Publication Data

US 2003/0116581 A1 Jun. 26, 2003

(51) Int. Cl.[7] ..... B65H 1/00

(52) U.S. Cl. ..... 221/48; 221/49; 221/50; 206/494; 428/126

(58) Field of Search ..... 221/48, 49, 50; 206/494, 812, 554; 428/126, 124, 130

(56) References Cited

U.S. PATENT DOCUMENTS

| | | | | |
|---|---|---|---|---|
| 1,046,325 | A | | 12/1912 | Normand |
| 1,123,470 | A | | 1/1915 | Betten |
| 2,730,267 | A | | 1/1956 | Marcalus |
| 3,119,516 | A | | 1/1964 | Donovan |
| 3,207,361 | A | | 9/1965 | Marcus |
| 3,401,927 | A | | 9/1968 | Frick et al. |
| 3,679,094 | A | | 7/1972 | Nissen et al. |
| 3,679,095 | A | | 7/1972 | Nissen et al. |
| 3,881,632 | A | | 5/1975 | Early et al. |
| 4,138,034 | A | | 2/1979 | McCarthy |
| 4,197,964 | A | | 4/1980 | Pryor |
| 4,221,304 | A | | 9/1980 | Wahl et al. |
| 4,481,243 | A | | 11/1984 | Allen |
| 4,513,051 | A | | 4/1985 | Lavash |
| 4,529,480 | A | | 7/1985 | Trokhan |
| 4,637,859 | A | | 1/1987 | Trokhan |
| 4,638,921 | A | | 1/1987 | Sigl et al. |
| 4,765,508 | A | | 8/1988 | Poppe |
| D300,892 | S | | 5/1989 | McCrory |
| 4,836,410 | A | | 6/1989 | Mastrobuoni |
| D317,540 | S | | 6/1991 | Reid et al. |
| 5,118,554 | A | * | 6/1992 | Chan et al. ..... 428/126 |
| 5,223,096 | A | | 6/1993 | Phan et al. |
| 5,240,562 | A | | 8/1993 | Phan et al. |
| 5,310,398 | A | | 5/1994 | Yoneyama |
| 5,368,188 | A | | 11/1994 | Twardowski |
| 5,497,903 | A | | 3/1996 | Yoneyama |
| 5,740,913 | A | | 4/1998 | McFarland |
| 5,868,276 | A | | 2/1999 | Loppnow et al. |
| 5,992,682 | A | | 11/1999 | Loppnow et al. |
| 6,045,002 | A | * | 4/2000 | Wierschke ..... 221/48 |
| 6,168,848 | B1 | | 1/2001 | Heath |
| 6,182,418 | B1 | | 2/2001 | McFarland |
| 6,213,344 | B1 | * | 4/2001 | Hill ..... 221/49 X |
| 6,238,328 | B1 | | 5/2001 | Loppnow et al. |
| 6,239,328 | B1 | | 5/2001 | Thompson |
| 6,250,495 | B1 | * | 6/2001 | Bando ..... 221/48 |

FOREIGN PATENT DOCUMENTS

| | | |
|---|---|---|
| EP | 1197460 A2 | 4/2002 |
| FR | 2269425 | 11/1975 |
| WO | 9806640 | 2/1998 |
| WO | 0141613 A1 | 6/2001 |

OTHER PUBLICATIONS

PCT Search Report Feb. 21, 2003.

* cited by examiner

*Primary Examiner*—David H. Bollinger
(74) *Attorney, Agent, or Firm*—Dority & Manning, P.A.

(57) ABSTRACT

An improved stacked sheet material assembly is disclosed. A carton or container for reliably releasing stacked tissues also is disclosed. The assembly includes at least a first web and a second web on the top of the assembly where dispensing is started. The first and second webs are shown using various efficient starter folding patterns, for releasing sheet material webs, or tissues, more reliably and consistently. Folding patterns preferably achieve dispensing of one tissue at a time, from the beginning of the carton to the end of the carton, with relative ease, no tissue tearing, and no package induced fallback.

27 Claims, 4 Drawing Sheets

FOLDED SHEET PRODUCT, DISPENSER AND RELATED ASSEMBLY

BACKGROUND OF THE INVENTION

Pop-up style dispensers have been used for some time to release individual folded sheet products such as facial tissues and the like. Such dispensers typically include a container and a stack, or "clip", of interfolded tissues disposed within the container. The tissues may be folded so that once the top tissue in the clip is withdrawn, subsequent sheets are individually presented above the top plane of the container for individual use.

It is known for an uppermost or starter web of a stack of longitudinally folded webs to be folded back upon itself so as to provide a centrally located longitudinally folded edge on a top of the stack as described, for example, in U.S. Pat. No. 3,401,927 to Frick. The folded edge, and overlying folds of the starter web, may be provided so as facilitate easy grasping and withdrawing of the uppermost web from the stack.

It is also known in the art to provide a next lower web interfolded with the uppermost web so that a portion of the next lower web is withdrawn from the stack at the time that the uppermost web is withdrawn. In this way, the next lower web is exposed to the user for successive removal from the stack. Typically, the overlying folds of the starter web are arranged so that a single uppermost fold extends away from the centrally located longitudinally folded edge and terminates in a free edge proximate the side edge of the stack as shown, for example, in U.S. Pat. No. 3,401,927.

A problem consumers sometimes experience is the tearing of one or more of the first few sheets dispensed. The earliest (usually top) sheets dispensed sometimes encounter excess friction, which causes the sheets to break or tear if the structure of the sheet is weaker than the frictional forces holding the tissue in place in the fold. When a container is nearly empty, tissue fallback sometimes occurs, so that the succeeding tissue is not pulled far enough through the container opening, and it falls back into the container. If this occurs, the tissue may fail to present itself for grasping. It sometimes has proven difficult to devise a tissue packaging method that will avoid tearing the first few tissues dispensed, and also at the same time avoid tissue fallback as the container is depleted.

Furthermore, many tissue dispensers include a plastic film that covers the opening of the container. Once the top tissue has been raised through a dispensing slit in the plastic film, subsequent tissues are held in an upright position by the plastic film for individual use. If the user must search with his or her fingers to identify the proper location to grasp the top sheet, the plastic film may become distorted, causing further dispensing problems.

Several other recent patents disclose methods of folding and arranging tissues in a stack, for pop-up style dispensing. See, for example, U.S Pat. Nos. 5,868,276 and 5,740,913 to McFarland (i.e.: "the McFarland patent"), as examples. The McFarland patent discloses a commercially known "double pop" tissue stacking arrangement. The "double pop" refers to the first two tissues of a clip being folded together in a common manner such that both tissues are removed from the carton at the same time to initiate dispensing of tissues from the carton.

The "double pop" arrangement sometimes avoids tearing, since two sheets folded together in unison may be strong enough to avoid tearing. However, many consumers dislike the fact that the first pull provides two sheets, which many consumers view as wasteful and unnecessary.

What is needed in the industry is an improved pop-up sheet material dispenser, sheet assembly, and related method for improving the dispensing of tissues. A tissue assembly and dispensing system that is capable of releasing one tissue at a time, from beginning to end, with relative ease, minimal tissue tearing, and with minimal tissue fallback would be desirable. Folding arrangements that provides for reliable and efficient dispensing are needed.

SUMMARY OF THE INVENTION

An improved stacked sheet material assembly, method, and pop-up dispenser is provided by way of the invention. The assembly includes at least a first web and a second web on top of the assembly where dispensing is to begin. The first and second webs may employ various efficient and reliable starter folding patterns, for releasing sheet material webs or tissues more reliably and consistently. Folding patterns may be deployed to reliably dispense only one tissue at a time, from the beginning of the carton to the end of the carton, with relative ease, minimal tissue tearing, and minimal package-induced fallback.

In one embodiment, the stacked sheet material assembly comprises a first web and a second web. The first web may be folded into four panels (or "folds") with creases between each. The first fold of the first web is positioned between the second and third folds. The second fold of the first web overlies the first fold, the third fold overlies the second web. Furthermore, the fourth fold is positioned beneath at least a portion of the second web. In one embodiment, the first and second folds of the first web join at a crease, the crease being positioned is and adapted for gripping of said first web. The second and third folds of the first web may join at a crease, the crease being positioned and adapted for gripping said first web.

In another embodiment, a stacked sheet material assembly provides a first web and a second web. The first web is folded and comprises a first fold, second fold, a third fold and a fourth fold. The first fold of the first web underlies the second web, and the fourth fold of the first web underlies the second web. The stacked sheet material assembly also may provide second and third folds positioned above the second web.

In yet another application of the invention, a stacked sheet material assembly provides a first web and a second web. The first web is folded, and comprises a first fold, a second fold, a third fold and a fourth fold. The first, second, and third folds of the first web each are positioned above the second web. The second web is quarter folded. In one embodiment, an insert or visual indicator is provided adjacent the first web.

In yet another embodiment of the invention, a stacked sheet material assembly is provided having a first web and a second web. The first web is folded, and includes a first fold, a second fold, a third fold and a fourth fold. The first fold of the first web underlies the second web, and the fourth fold of the first web underlies the second web.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Figure 1:
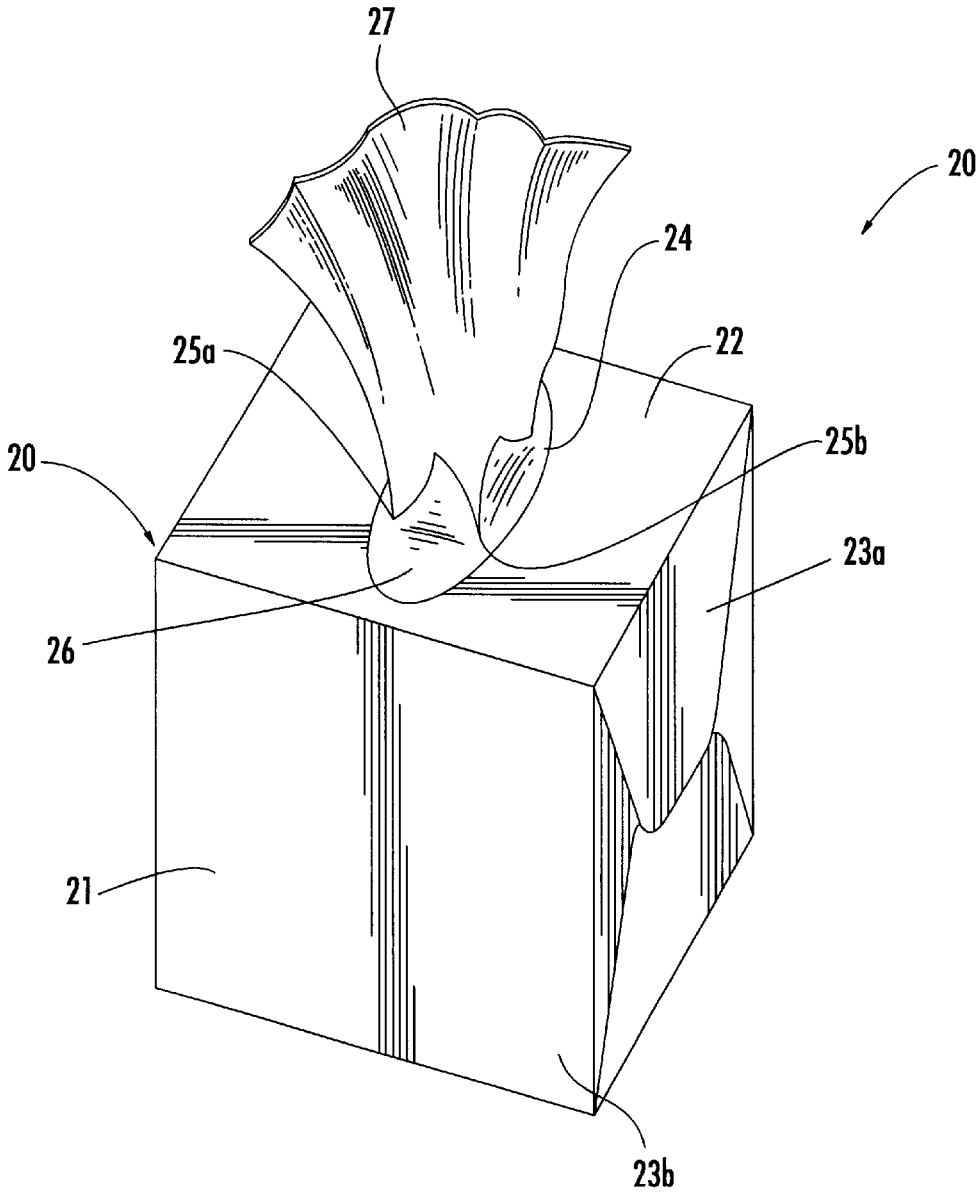
FIG. 1 is a perspective view of a carton of interfolded tissues illustrating one embodiment of the present invention.

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

In one embodiment of the invention, a pop-up tissue dispenser includes a carton and a clip of tissues disposed within the carton. The carton includes a plurality of walls that define a carton opening through which the tissues may be removed from the carton. The clip includes tissues having a folding pattern with a starter fold that will efficiently provide tissues to the consumer, with minimal tearing or fallback into the container.

The clip of tissues may be interfolded, prefolded interfolded, or non-interfolded. As used herein, the phrase "prefolded interfolded" or "interfolded" tissues means that the tissues are folded and interleaved with neighboring tissues immediately above and/or below in the clip of tissues. The tissues can be interleaved by any suitable means, including the use of an interfolder as employed in the papermaking arts. If an interfolder is used, consecutive tissues will be attached to each other at perforation lines. In such cases, the unperforated segments of the perforation lines should be sufficiently weak to permit the consecutive tissues to separate from each other upon removal from the carton. This can be controlled by the degree of perforation of the tissue sheet. Tissues that may be employed in a non-interfolded clip which are not interleaved with neighboring tissues are releasably attached to neighboring tissues so that upon dispensing one tissue, the next adjacent tissue is ready for dispensing.

Surprisingly, new patterns of folding have been discovered that provide remarkable additional benefits in pop-up style dispensers. In several embodiments of the invention, a pop-up tissue dispenser includes a clip of interfolded tissues disposed within a carton. A series of webs are provided with a plurality of folds to achieve various degrees of strength and pop-up characteristics. That is, some interfolding patterns provide increased amounts of friction. Frictional contact between tissues assists in pulling the next successive tissue into the window opening, for "pop-up" dispensing. Other patterns provide somewhat less friction, which tend to avoid tearing of the tissue when extracted from the container.

Webs or sheets may be folded in a stacked arrangement. Each web or sheet, when laid flat, may assume a square or rectangular shape, in many instances. Many different folds may be employed, and several embodiments of the invention are shown in the attached Figures. Folds are defined as first folds, second folds, third folds, and the like by reference to their respective position on the sheet. That is, a sheet or web having four folds, for example, typically would have a first fold, second fold, third fold, and fourth fold in that order, respectively, as when moving from one edge of the sheet to the opposite edge of that sheet.

A folded sheet, for example, would have four panels or folds and three creases. One crease appears at the junction of each fold. For example, a first crease is at the junction of the first fold and a second fold, as will be further described below. A bifolded sheet, for example, would have two folds two folded panels and one crease, while a trifolded sheet would have three folded panels and two creases.

It should be understood that the term "web," as used herein, is meant to include a sheet material made of one or more plies of material so that a multiple-ply sheet material is considered to be a "web" of sheet material, regardless of the number of plies.

Alternatively, the lower webs can be formed as upwardly opening C-shaped webs having a base fold, and two wing folds. In such an arrangement, the lower webs are not interfolded, but rather are stacked one upon the other. An interfolded stack of sheet material webs is produced by interfolding webs using a preceding succession of conventional alternate right-hand and left-hand folding boards, as taught, for example, in U.S. Pat. No. 3,401,927 to Frick and U.S. Pat. No. 5,868,276 to Loppnow, et. al.

Figure 6:
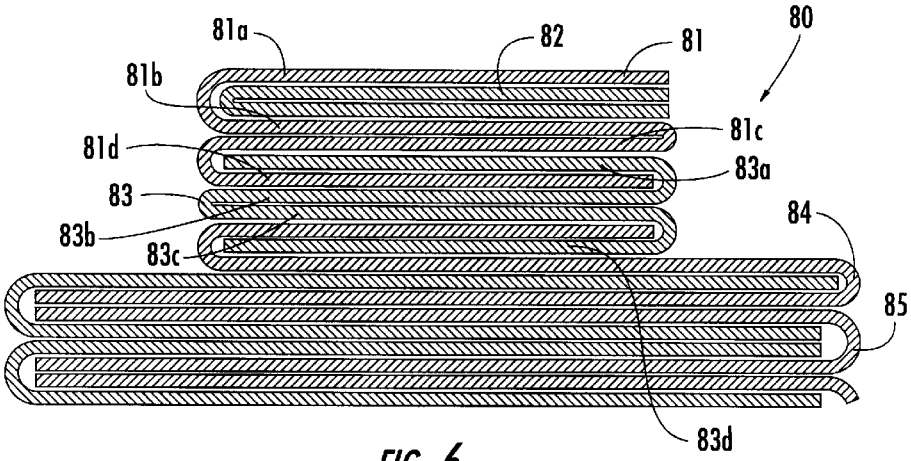
FIG. 6 shows a further embodiment of the invention having a particular folding arrangement.

In some applications of the invention, as shown for example in FIG. 6, a visually distinctive insert or tissue may be employed. In the case of a visually distinctive tissue, the tissue would be oriented within the carton such that a visual indicator may be observed through the carton opening prior to removal of tissues from the carton.

The term "visual indicator" is used herein to mean a continuous or intermittent pattern disposed on or in a tissue to visually identify for the user the best location to grasp a tissue to initiate dispensing. The pattern may consist of designs or symbols, such as alphanumeric characters, that are visually distinguishable to the human eye from surrounding regions of the tissue. The pattern can consist of an insert web or tissue, and is desirably formed of a color that stands out from the surrounding portions of the tissue and is clearly identifiable through any plastic film covering the opening to the container.

Turning to FIG. 1, a pop-up dispenser formed according to one embodiment of the present invention is shown as an upright, pop-up facial tissue dispenser 20. The invention may also be utilized to dispense other types of folded sheet products. Thus, the term "tissue" is not intended to be limited to facial tissues, but is used herein to include any individual sheet product, such as dry or moistened wipes, household or industrial wipes, soap or fabric softening sheets, and the like. Thus, the term "tissue" is used herein in its broadest sense as known in the art.

The tissue dispenser 20 includes a clip 21 of prefolded interfolded tissues disposed within the dispenser 20. Sometimes, the dispenser 20 is described herein as a "carton". The clip 21 of tissues is inside the dispenser 20, and therefore is not shown in FIG. 1 but its location is referenced as clip 21. A top wall 22 forms part of a rectangular parallel structure comprising also an opposite bottom wall (not shown in FIG. 1). Furthermore, a plurality of sidewalls 23*a*–*b* (as two examples) are provided around the sides of the dispenser 20. The sidewalls that are visible in FIG. 1 have been provided with reference numerals 23*a* and 23*b*. The dispenser 20 may be constructed in a variety of sizes and shapes from material such as paper board, plastic and the like. For example, in an alternate embodiment the dispenser 20 may include a single cylindrical shaped sidewall extending between the top and bottom walls (not shown). Furthermore, as further illustrated in FIG. 1, any of the sidewalls such as sidewalls 23*a* or 23*b* may be constructed of one or more panels that are bonded together by adhesives, thermal bonds, or other suitable means.

The top wall 22 of the dispenser 20 defines a carton opening 24 in the form of an aperture through which tissues may be individually removed from the dispenser 20. The dispenser 20 optionally includes a plastic film 26 overlaying the carton opening 24 and incorporating intersecting dispensing slits 25*a* and 25*b*. The use of the plastic film 26 is desirable, particularly for larger carton openings, in order to protect the tissues within the carton and to provide sufficient resistance to prevent multiple tissue dispensing. The plastic film 26 may be bonded to the top wall 22 by adhesives or other suitable means, and the dispensing slits 25*a* and 25*b* may assume other forms such as a single slit, an aperture, or the like. The dispenser 20 may optionally be provided with a removable panel (not shown) that creates a carton opening when the panel is removed. FIG. 1 further shows the tissue 27 standing upright from the top wall 22 of the dispenser 20.

Figure 2:
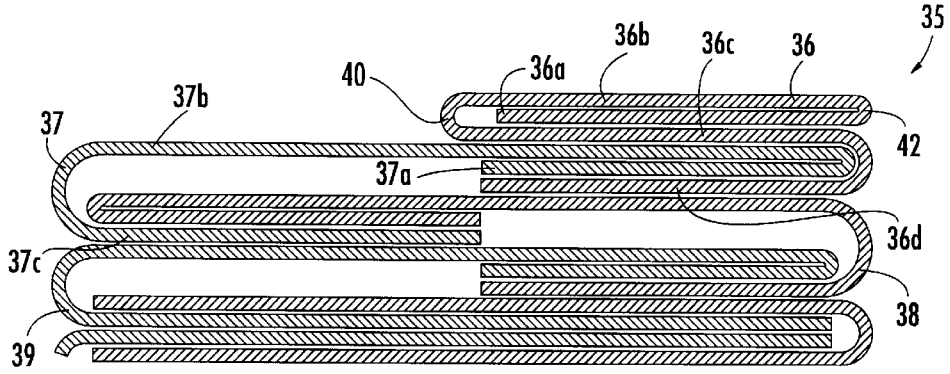
FIG. 2 shows one embodiment of the invention having a particular folding arrangement.
Figure 2A:
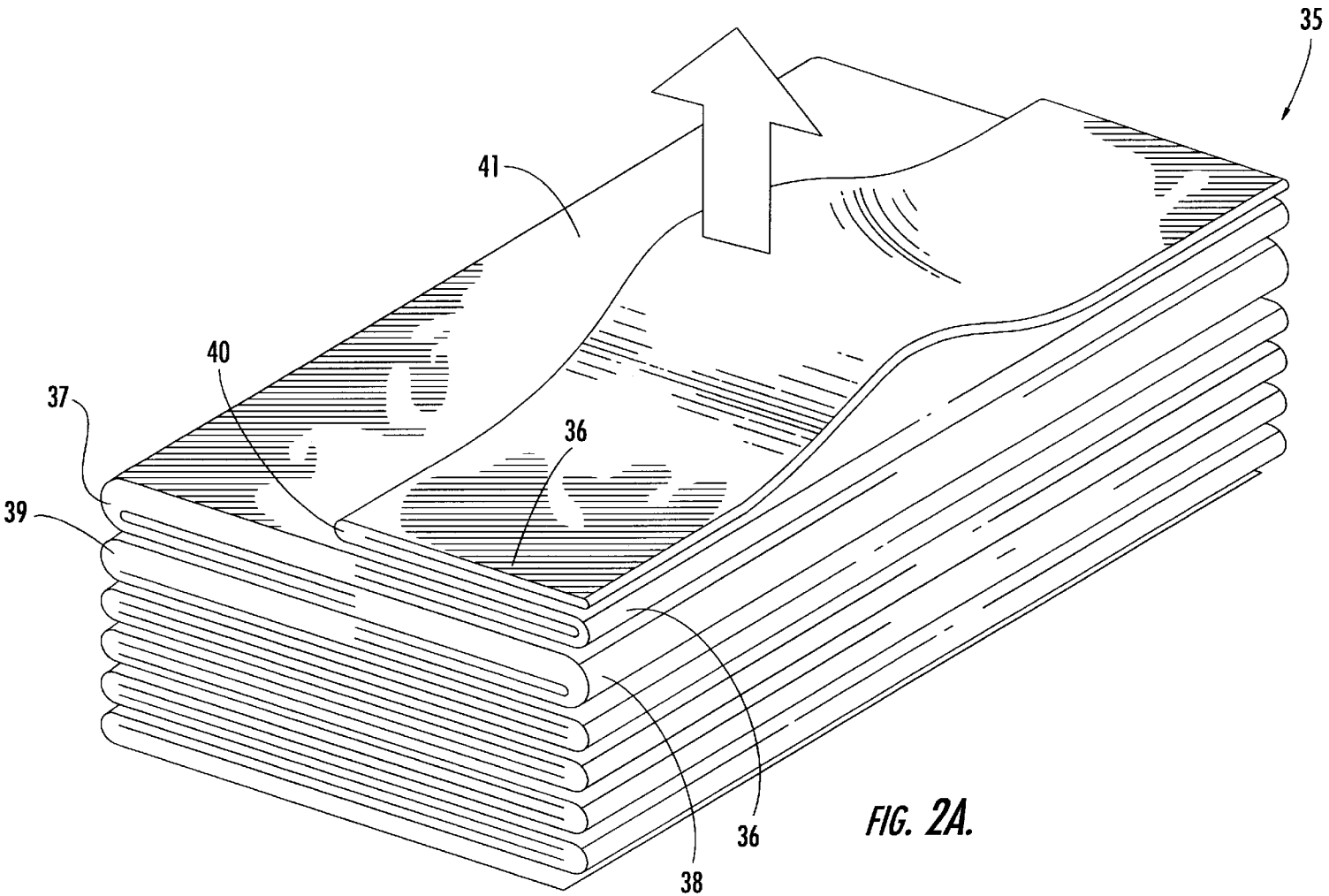
FIG. 2A shows a perspective view of the folding pattern of the embodiment shown in FIG. 2.

An individual clip 21 of prefolded interfolded tissues is illustrated in FIG. 2A, which will be described further below. FIG. 2A shows a clip of tissues laid flat for purposes of illustration, but would be curved from end to end and placed within the dispenser 20 in the manufacture of the invention.

In FIG. 2A, a stacked sheet material assembly 35 comprising a series of tissues of webs stacked upon each other in a particular pattern. For purposes of this specification, the term "web" may be used in a manner that is more broad than "tissue".

A first web 36 is shown at the top of the stacked sheet material assembly 35 in FIG. 2A. A second web 37 is below first web 36, and a third web 38 is further below second web 37. Finally, a fourth web 39 is even further below, and the remaining webs are not numbered in FIG. 2A. Hundreds of webs could be applied in a stacked sheet material assembly 35, and FIG. 2A illustrates the top few webs or sheets which would be utilized at the top of the stacked sheet material assembly 35. A crease 40 also is shown in FIG. 2A, which forms a reference point for the consumer to grasp the first web 36 and pull it upwards as shown by the arrow in FIG. 2A out through the carton opening 24 of FIG. 1 as shown.

FIG. 2 shows a cross section of the stacked sheet material assembly 35 shown also in FIG. 2A. In FIG. 2, a first web 36 comprises a first fold 36*a*, a second fold 36*b*, a third fold 36*c*, and fourth fold 36*d*.

For purposes of identification in this specification, folds are identified as "first fold", "second fold", "third fold" and the like by reference to their respective position on the sheet, from one edge of the sheet to an opposite of the sheet, respectively.

Likewise, a second web 37 is shown having a first fold 37*a*, a second fold 37*b*, and a third fold 37*c* as shown in FIG. 2. The first fold 36*a* of the first web 36 is positioned between the second fold 36*b* and the third fold 36*c*. This results from the folding pattern in which the first web 36 is multiple folded as shown in FIG. 2. Furthermore, the second fold 36*b* overlies the first fold 36*a*. Further, the third fold 36*c* overlies the second web 37. Also, the fourth fold 36*d* of the first web 36 is positioned beneath at least a portion of the second web 37. The folding pattern as shown in FIG. 2 provides significant advantages in the pop-up dispensing of the stacked sheet material assembly 35 when loaded into a dispenser 20 (See FIG. 1).

Creases are formed at the junction of each fold of each web in the stacked sheet material assembly 35. For example, the first fold 36*a* forms a crease where it meets the second fold 36*b*. That crease is indicated at crease 42. Likewise, a crease 40 is shown between second fold 36*b* and third fold 36*c*. The crease 40 forms a position for grasping by the consumer to remove the first web 36 (i.e., first tissue) from the dispenser 20 when the stacked sheet material assembly 35 is loaded into a dispenser 20 (See dispenser 20 in FIG. 1).

In FIG. 2, the second web 37 is comprised of a first fold 37*a*, second fold 37*b*, and third fold 37*c*. A third web 38 and a fourth web 39 also are shown in FIG. 2. Only the top few webs are shown in FIG. 2, which are critical to the start-up dispensing from a dispenser 20. The folding pattern shown in FIG. 2 is sometimes called an "S Fish Hook" configuration, in part because the first web 36 forms an S shape, and the second web 37 forms in a "fish hook" shape.

Figure 3:
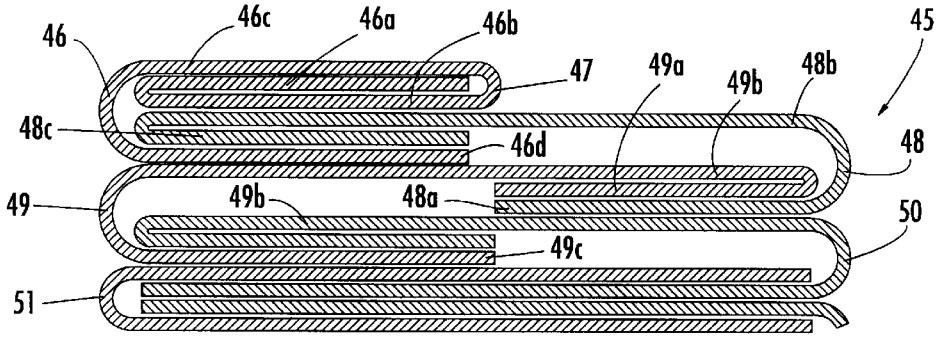
FIG. 3 shows another embodiment of the invention having a particular folding arrangement.

FIG. 3 provides a flat sheet material assembly 45 which includes a first web 46 having a first fold 46*a*, second fold 46*b*, third fold 46*c*, and fourth fold 46*d*. A crease 47 is formed at the junction of second fold 46*b* and third fold 46*c*. A second web 48 is also provided, as shown in FIG. 3. The second web 48 comprises a first fold 48*a*, a second fold 48*b*, and a third fold 48*c*. A third web 49 is shown with first fold 49*a*, second fold 49*b*, and third fold 49*c*. The second web 48 is shown partially beneath the third web 49. The third web 49 is also partially beneath a third web 50. A fourth web 51 is shown as well.

The folding arrangement in FIG. 3 is sometimes referred to as the "E Fish Hook" design, because the first web 46 resembles the shape of the letter "e", and the second web 47 is in the shape of a fish hook. In this particular arrangement, the second fold 46*b* and third fold 46 join at crease 47, the crease 47 being positioned and adapted for gripping of said first web 46 by a consumer.

Figure 4:
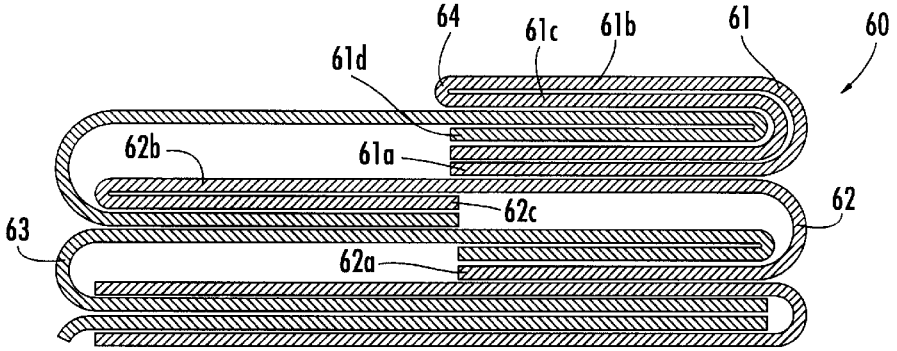
FIG. 4 reveals a further embodiment of the invention having a particular folding arrangement.

In FIG. 4, another web folding pattern is shown. This pattern is sometimes known as the "Double Fish Hook" design. A stacked sheet material assembly 60 is above first web 61, with a first fold 61*a*, second fold 61*b*, and third fold 61*c*. Crease 64 is formed at the junction of the second fold 61*b* and the third fold 61*c*. A second web 62 comprises of a first fold 62*a*, second fold 62*b*, and third fold 62*c*. A third web 63 also is shown.

Figure 5:
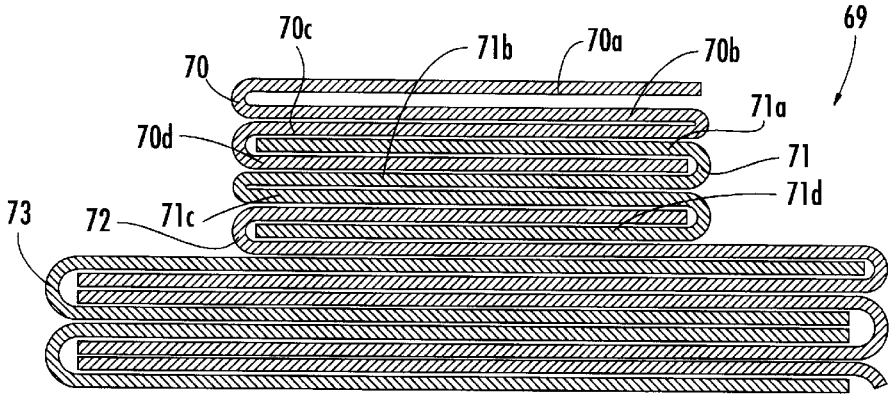
FIG. 5 shows yet another embodiment of the invention.

FIG. 5 shows a stacked sheet material assembly 69 with a first web 70 having first fold 70*a*, second fold 70*b*, third fold 70*c* and fourth fold 70*d*. A second web 71 further comprises first fold 71*a*, second fold 71*b*, third fold 71*c* and fourth fold 71*d*. A third web 72 and a fourth web 73 also are shown in FIG. 5. This alternate embodiment of the invention provides an efficient folding pattern that is suited for pop-up dispensers.

In FIG. 6, a stacked sheet assembly 80 is provided having a first web 81 with first fold 81*a*, second fold 81*b*, third fold

81*c*, and fourth fold 81*d*. A visual indicator 82 is shown in FIG. 6, which may be employed in at least one embodiment of the invention. In some applications, the visual indicator 82 could comprise a gold ribbon or other selected color with a sheet or web of tissue laminated to the edge of the first web 81, as one example. In other examples a ribbon or colored tapestry portion could be provided. Some applications may include a differently colored first web 81, to notify the user in a visual manner that the user is to grasp the first web 81 when commencing the release of tissues.

The first web 81 comprises first fold 81*a*, second fold 81*b*, third fold 81*c* and fourth fold 81*d*. A second web 83 comprises a first fold 83*a*, second fold 83*b*, third fold 83*c* and fourth fold 83*d*. Furthermore, a third web 84 and a fourth web 85 also are shown in FIG. 6. This particular embodiment of the invention is sometimes known as "Ribbon W Fold" The fold shown in FIG. 6 is similar to the fold shown in FIG. 5, with the exception that the fold pattern of FIG. 6 provides the visual indicator 82 as shown.

Figure 7:
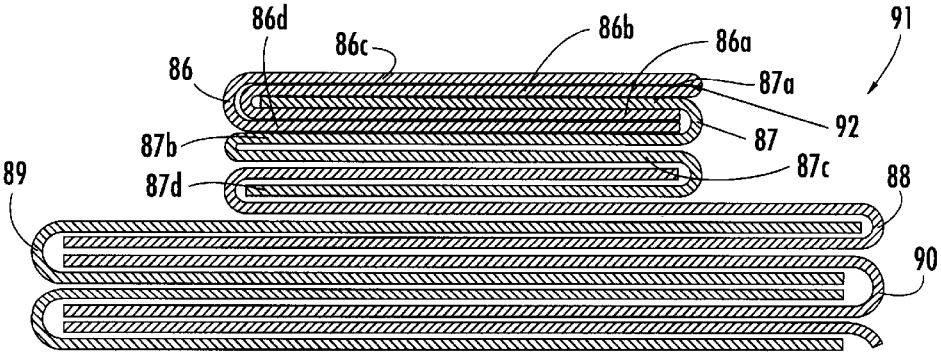
FIG. 7 illustrates yet another embodiment of the invention having a particular folding arrangement.

FIG. 7 provides a folding pattern sometimes known as "Double C-W". In FIG. 7, a first web 86 is comprised of a first fold 86*a*, second fold 86*b*, third fold 86*c* and fourth fold 86*d*. A second web 87 having first fold 87*a*, second fold 87*b*, third fold 87*c*, and fourth fold 87*d* is shown. A third web 88 also is shown. Fourth web 88 and fifth web 89 are further provided at lower points in the stack.

In FIG. 7, this arrangement results in the first web 86 being multiple folded, wherein the first fold 86*a* of the first web 86 underlies the second web 87. Furthermore, the fourth fold 86*d* of the first web 86 underlies the second web 87. In some instances, the stacked sheet material assembly 91 of FIG. 7 may provide a second fold 86*b* and a third fold 86*c* of the first web 86 which are positioned above the second web 87. Furthermore, the second fold 86*b* and the third fold 86*c* of the first web 86 may join at a crease 92 as shown in FIG. 7. The crease 92 may provide the point at which consumers may grasp the first web 86 and pull it from a container 20 (See FIG. 1).

The invention may include the various embodiments of the application which may be provided in a pop-up style tissue dispenser which comprises a carton and a clip of facial or bath tissues having the folding patterns as previously described. Furthermore, other embodiments of the invention may not relate to facial or bathroom tissues at all, but instead be directed to stacked sheet material assemblies for releasing wet wipes, dry wipers for industrial applications, napkins, towels, or other varieties of stacked sheets. Thus, the invention may provide an improved stacked sheet material assembly. In other embodiments, the invention may provide an improved product, in which the product comprises a container with a stacked sheet material assembly provided within the container. FIG. 1 shows one example of such a container, but other types of containers which are not disposable, but instead are permanent, could be used.

For example, some industrial applications could provide stacked wipers or other folded web products wherein the stacked assembly is provided as a refill, and the dispenser is a permanent fixture in a factory, or other commercial setting. There is no limit to the uses to which the invention may be applied, and the examples shown in the Figures and described above are merely exemplary embodiments of the invention.

In the case of tissues, all of the tissues may be generally uniformly white in color and substantially identical. In other applications, a visual indicator may be printed upon the top tissue that is adjacent to the secondary fold. A visual indicator as described may comprise any of the indicators as previously discussed, or in other applications could provide an optional textual message oriented at a convenient location on the top tissue.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A stacked sheet material assembly, comprising:

a first web and a second web, said first web being folded, said first web comprising, a first fold, second fold, third fold, and fourth fold, wherein the first fold of the first web is positioned between the second and third folds, the second fold overlies the first fold, the third fold overlies the second web, and the fourth fold is positioned beneath at least a portion of the second web.

2. The stacked sheet material assembly of claim 1 in which the second web comprises a first, second and third fold.

3. The stacked sheet material assembly of claim 2 in which the folds of the second web are arranged such that the first fold of the second web is positioned between the second and third folds of the second web.

4. The stacked sheet material assembly of claim 1 in which the first and second folds of the first web join at a crease, the crease being positioned and adapted for gripping of said first web.

5. The stacked sheet material assembly of claim 1 in which the second and third folds of the first web join at a crease, the crease being positioned and adapted for gripping said first web.

6. A stacked sheet material assembly, comprising:

a first web and a second web, said first web being folded, said first web comprising a first fold, a second fold, a third fold and a fourth fold, wherein the first fold of the first web underlies the second web, further wherein the fourth fold of the first web underlies the second web.

7. The stacked sheet material assembly of claim 6 in which the second and third folds of the first web are positioned above the second web.

8. The stacked sheet assembly of claim 6 in which the second and third folds of the first web join at a crease, the crease being positioned for gripping of the first web.

9. The stacked sheet assembly of claim 6 in which the first web is C-folded.

10. The stacked sheet assembly of claim 6 in which the second web provides a first fold, a second fold, and a third fold.

11. The stacked sheet assembly of claim 10 in which the first and second folds of the second web are positioned between one or more folds of the first web.

12. The stacked sheet assembly of claim 11 further comprises a third web, whereby the third fold of the second web lies beneath at least a portion of the third web.

13. A stacked sheet material assembly, comprising:

a first web and a second web, said first web being folded, said first web comprising a first fold, a second fold, a third fold and a fourth fold, wherein the first, second, and third folds of the first web each are positioned above the second web, and the second web is quarter folded.

14. The stacked sheet material assembly of claim 13 in which the second web comprises a first fold, second fold, third fold, and fourth fold, wherein the first fold of the second web is positioned above at least one fold of the first web.

15. The stacked sheet material assembly of claim 14 in which the first fold of the second web is positioned above the fourth fold of the first web.

16. The stacked sheet material assembly of claim 13 in which an insert is provided adjacent the first web, the insert being adapted for providing a visual indicator.

17. The stacked sheet material assembly of claim 13 in which the first web and second web are provided in different colors.

18. A stacked sheet material assembly, comprising:

a first web and a second web, said first web being quarter folded, said first web comprising a first fold, a second fold, a third fold and a fourth fold, wherein the first fold of the first web underlies the second web, further wherein the fourth fold of the first web underlies the second web.

19. The stacked sheet material assembly of claim 18 in which the second and third folds of the first web are positioned above the second web.

20. The stacked sheet assembly of claim 18 in which the second and third folds of the first web join at a crease, the crease being positioned for gripping of the first web.

21. The stacked sheet assembly of claim 18 in which the first web is C-folded.

22. The stacked sheet assembly of claim 18 in which the second web provides a first fold, a second fold, a third fold, and a fourth fold.

23. The stacked sheet assembly of claim 22 in which at least two folds of the first web are positioned between the first and second folds of the second web.

24. A pop-up tissue dispenser, comprising:

(a) a carton comprising a plurality of walls defining therein a carton opening, and (b) a clip of tissues disposed within the carton, the clip comprising a first web and a second web, said first web being folded, said first web comprising, a first fold, second fold, third fold, and fourth fold, wherein the first fold of the first web is positioned between the second and third folds, the second fold overlies the first fold, the third fold overlies the second web, and the fourth fold is positioned beneath at least a portion of the second web.

25. A pop-up tissue dispenser, comprising:

(a) a carton comprising a plurality of walls defining therein a carton opening, and (b) a clip of tissues disposed within the carton, the clip comprising a first web and a second web, said first web being folded, said first web comprising a first fold, a second fold, a third fold and a fourth fold, wherein the first fold of the first web underlies the second web, further wherein the fourth fold of the first web underlies the second web.

26. A pop-up tissue dispenser, comprising:

(a) a carton comprising a plurality of walls defining therein a carton opening, and (b) a clip of tissues disposed within the carton, the clip comprising a first web and a second web, said first web being folded, said first web comprising a first fold, a second fold, a third fold and a fourth fold, wherein the first, second, and third folds of the first web each are positioned above the second web, and the second web is quarter folded.

27. A pop-up tissue dispenser, comprising:

(a) a carton comprising a plurality of walls defining therein a carton opening, and (b) a clip of tissues disposed within the carton, the clip comprising a first web and a second web, said first web being folded, said first web comprising a first fold, a second fold, a third fold and a fourth fold, wherein the first fold of the first web underlies the second web, further wherein the fourth fold of the first web underlies the second web.

* * * * *